US005542466A

United States Patent [19]

Brückner et al.

[11] Patent Number: 5,542,466

[45] Date of Patent: Aug. 6, 1996

[54] METHOD AND DEVICE FOR THE CASTING OF MOLTEN MATERIAL TO NEARLY FINAL INTENDED DIMENSIONS BY COMMENCING SOLIDIFICATION OF MOLTEN MATERIAL IN A CASTING NOZZLE PASSAGE WHILE MOVING THE SOLIDIFYING MATERIAL THROUGH THE PASSAGE BY ULTRASONIC VIBRATIONS

[75] Inventors: Raimund Brückner, Niedernhausen; Rüdiger Grau, Grosskrotzenburg, both of Germany

[73] Assignee: Didier-Werke AG, Wiesbaden, Germany

[21] Appl. No.: 412,191

[22] Filed: Mar. 28, 1995

[30] Foreign Application Priority Data

Mar. 28, 1994 [DE] Germany ..... 44 10 511.8

[51] Int. Cl.[6] ..... B22D 11/04

[52] U.S. Cl. ..... 164/478; 164/133; 164/71.1

[58] Field of Search ..... 164/133, 337, 164/71.1, 900, 478, 416

[56] References Cited

U.S. PATENT DOCUMENTS

| | | | |
|---|---|---|---|
| 3,415,306 | 12/1968 | Olsson | 164/83 |
| 4,073,333 | 2/1978 | Korshunov et al. | 164/476 |
| 4,524,820 | 6/1985 | Gullotti et al. | 164/900 |
| 5,355,935 | 10/1994 | Nogues | 164/416 |

FOREIGN PATENT DOCUMENTS 58-25846 2/1983 Japan .

OTHER PUBLICATIONS

Patent Abstracts of Japan, vol, 12, No. 454 (M–769), 29 Nov. 1988.

Patent Abstracts of Japan, vol. 12, No. 91 (M–679), 24 Mar. 1988.

*Primary Examiner*—Jack W. Lavinder
*Assistant Examiner*—Randolph S. Herrick
*Attorney, Agent, or Firm*—Wenderoth, Lind & Ponack

[57] ABSTRACT

A method of casting molten material into a strip-shaped product having substantially intended final dimensions that first supplies molten material into the interior of a vessel having a casting nozzle connected thereto. The nozzle is formed of a refractory ceramic material and has a passage extending therethrough from an inlet opening connected directly to the interior of the vessel to an outlet opening. The nozzle is oriented relative to the vessel so that the outlet opening is positioned at a location higher than the inlet opening. Molten material passes from the vessel interior directly through the inlet opening and into the passage until an upper level of molten material in the passage is the same as an upper level of molten material in the vessel interior and below the outlet opening. Solidification of the molten material is commenced in the passage, thereby forming solidifying material. The solidifying material is moved through the passage in a direction toward the outlet opening, during which the material further solidifies. The thus further solidified material is discharged from the outlet opening by imparting to the nozzle, and thereby to the material, ultrasonic vibrations including at least one vibration component in the direction toward the outlet opening.

19 Claims, 1 Drawing Sheet

A
B
2
H
b
a
c
F
3
II
6
S
7
5
4
W
1
8

METHOD AND DEVICE FOR THE CASTING OF MOLTEN MATERIAL TO NEARLY FINAL INTENDED DIMENSIONS BY COMMENCING SOLIDIFICATION OF MOLTEN MATERIAL IN A CASTING NOZZLE PASSAGE WHILE MOVING THE SOLIDIFYING MATERIAL THROUGH THE PASSAGE BY ULTRASONIC VIBRATIONS

BACKGROUND OF THE INVENTION

The invention relates to a method for the casting of molten material, particularly molten metal, in nearly final intended dimensions from a vessel through a canal, channel or discharge nozzle connected thereto at an in-flow or inlet opening and also having, if necessary, an out-flow or discharge opening. The invention relates further to a device or apparatus for accomplishing such method.

A method of this type is described in EP 0 334 802 A2 wherein molten metal flows from a vessel through a channel-type casting nozzle onto a circulating cooling belt. To allow the molten metal to solidify in an evenly thick band, the distance of the casting nozzle from the cooling belt has a certain dimension. The pressure of the molten material in the vessel is adjusted accordingly. Based on this control loop, fluctuations in the band thickness can result, which are evened out by a smoothing roller.

In "Patent Abstracts of Japan" vol. 12, No. 454 (M- 769) 29 Nov. 1988, JP-A-63 183 747, a method is described in which molten material is brought onto an inclined cooled wall of a vessel for solidifying of the molten material. The wall is acted upon by ultrasound vibrations which are to prevent the molten material from freezing onto the wall. The hardening molten material is pulled upwards off the wall as a band by rollers. An even band thickness is difficult to achieve since the band thickness achieved is dependent on numerous parameters. Furthermore, the requirement for "clean steel" cannot be taken into account through open casting when the liquid metal comes into contact with the air.

A similar method is described in "Patent Abstracts of Japan" vol. 12, No. 91 (M-679) 24 Mar. 1988, J-A-62 230 458.

DE-OS 42 40 849 discloses a method in which molten metal flows onto a receptacle plate. The receptacle plate is excited by ultrasound vibrations such that the molten metal hardening on the receptacle plate is impressed by a motion component in the direction of conduction. This hardly has an effect on the thickness of the band yielded by the hardening melted material. Open casting takes place in this application as well.

SUMMARY OF THE INVENTION

The object of the invention is to provide a method of the above type but with which an improvement in dimensional accuracy of the section of hardening material, such as metal, is achieved. A further object is to make hardening of the metal possible when hermetically sealed. A still further object of the invention is to provide an apparatus or device for the accomplishment of such method, and whereby hardening of molten material such as metal is possible in shapes other than purely rectangular.

According to the invention, these objects are achieved in that an enclosed discharge nozzle has therethrough a passage or channel having therein a transfer zone wherein the molten material changes from a liquid to a solid state. The nozzle contains on one hand still fluid material and on the other hand already solidified molten material and controls the cross sectional profile of the hardening molten material. It is not necessary that the strip formed by the hardening of the material fill the passage above the level of the molten material through the total height H of the passage. Even dimensions of the thickness and width of the cross sectional profile are achieved, if necessary different profiles. High frequency vibrations are imparted to the nozzle and ensure on one hand that the hardening molten material does not freeze onto the nozzle walls, and on the other hand an influence of the motion and/or distribution of the molten material in the passage. The vibrations are at least 5 kHz, preferably at least 20 kHz.

In accordance with a further feature of the invention, the nozzle is heated and/or cooled. Through the heating of the nozzle a premature hardening of the molten material is prevented. The hardening of the molten material in the form of a strip-shaped shell is provided by cooling, whereby a still liquid core of molten material exists in a hardened shell of a strip of material. In particular, the material which enters the passage in liquid form is cooled in its further course of flow in the passage at least on one side, to form a solidified strip-shaped shell.

The nozzle can be water cooled like a known continuous casting die, in which case it is possible that it is formed of metal, especially copper. It is advantageous however that the nozzle be formed of a fire-proof ceramic, since then materials can be chosen which are not or are only slightly moistened by metal to be cast. In this way, the effect of the action of the vibrations on the nozzle is in the sense of preventing freezing of the hardening molten material on the nozzle walls. Through the use of a fire-proof ceramic nozzle it is possible that the molten material therein remains fluid in a heated zone without forming a shell, which can be advantageous for metallurgical reasons. The molten material can be pointedly cooled in a connected cooling zone without consideration of the distortion of a metal die. Also with regard to wear, a ceramic nozzle is preferred to a metal nozzle.

In accordance with a further feature of the invention, the nozzle is acted upon by at least one vibration component in the direction of flow of the strip. This vibration component causes the molten material, and especially the molten material in its hardening phase, to be transported away from the vessel. Vibration components perpendicular to the direction of flow of the metal strip prevent the molten material from freezing on the nozzle walls. Preferably all of the walls of the nozzle surrounding the molten material are acted upon by vibration components perpendicular to the direction of flow. Vibration components across the direction of flow or at a desired angle to the direction of flow support a desired distribution of the molten material in the nozzle.

In accordance with a further feature of the invention, the discharge rate, that is to say the rate at which the hardening or hardened metal is conducted out of the nozzle in the direction of flow, can be controlled. This can occur through control of the amplitudes and/or frequencies of the vibration components directed in the direction of flow. The discharge rate can also be achieved through changes in the inclination of the nozzle. The discharge rate can also be controlled by means of excess or negative pressure in the vessel-nozzle system, whereby the excess or negative pressure effects the molten material level therein. A type of gravitational conduction can be overridden by conduction by means of the vibration components by changing the inclination of the nozzle. Conduction achieved by excess or negative pressure conduction can be overridden by conduction achieved by vibration.

BRIEF DESCRIPTION OF THE DRAWINGS

Additional advantageous features of the method and configurations of a device for the accomplishment of the method will be apparent from the following description of an illustrative example, with reference to the accompanying drawings wherein.

DETAILED DESCRIPTION OF THE INVENTION

Figures 1, 2, 3:
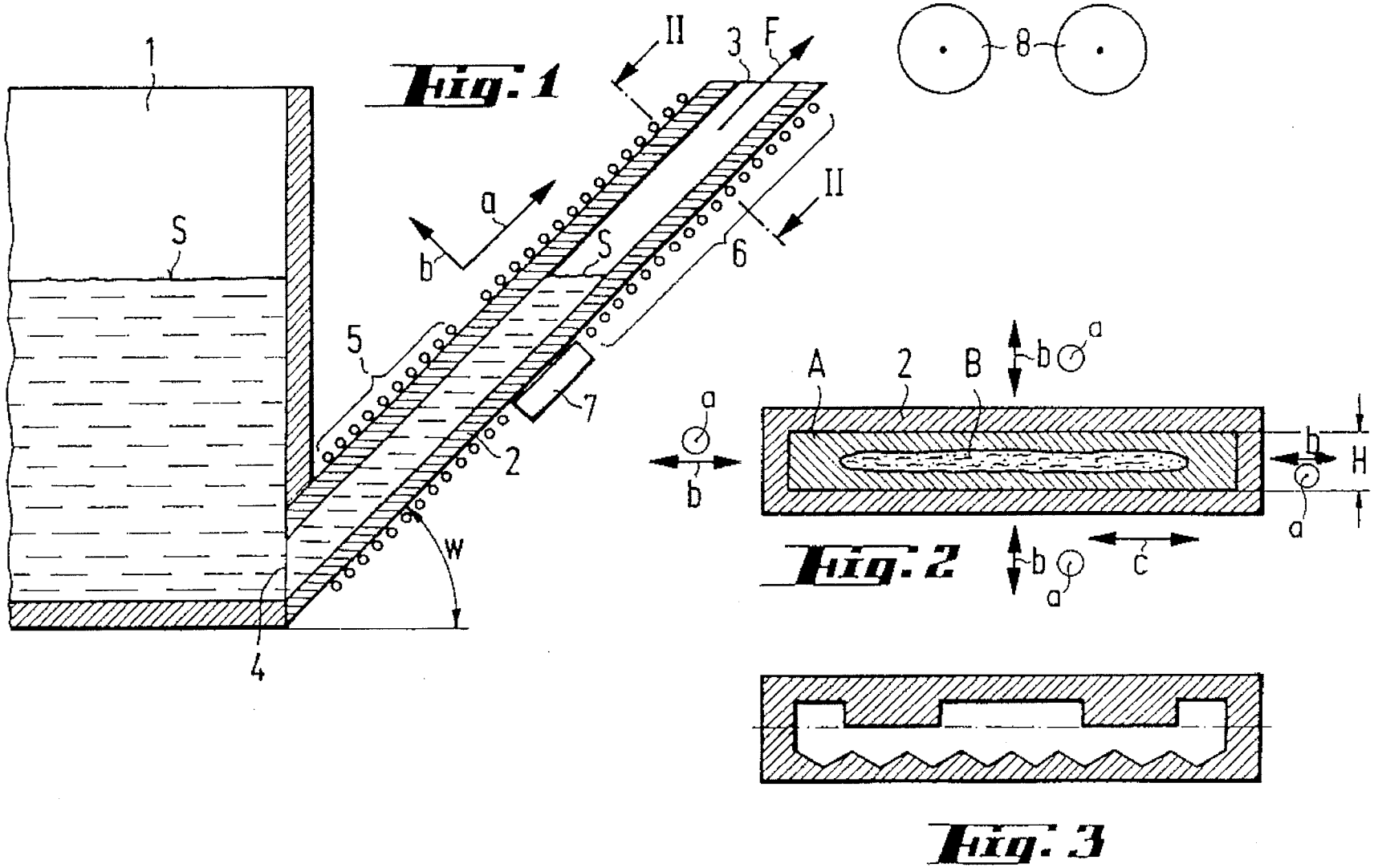
FIG. 1 is a partial cross section of a metallurgical vessel with a nozzle according to the invention.
FIG. 2 is a section along line II—II in FIG. 1.
FIG. 3 is a cross section of a nozzle which is other than rectangular in the area of a hardening zone.

An enclosed discharge nozzle 2 extends from a lower portion of a metallurgical vessel 1 and is inclined at an angle W to the horizontal. The upper level of molten material in the vessel 1 and in the nozzle 2 is noted at S. The nozzle 2 extends to a level above the level S of molten material. A discharge or outlet opening 3 lies above the level S of the molten material. An inlet or in-flow opening 4 is provided at the bottom or lower portion of vessel 1.

An inductive heating unit 5 is arranged on the nozzle 2 below the level S of the molten material. A cooling unit 6 is provided on the nozzle partially above and partially below the level S of molten material. At least one vibration generator 7 is arranged on the nozzle 2 and acts thereon with high frequency vibrations, in particular ultrasound vibrations.

The cross section profile of the nozzle 2 (compare FIGS. 2 and 3) is closed on all sides and defines therein a passage or channel for the cross section of a metal band, or rather a thin slab, which is to be cast. A strip profile which is less thick than the height H of the passage also can be conducted or discharged therefrom. In such case, a screening or protection in the passage connected directly with the vessel and closed on all sides (up to the out-flow opening) to protect the molten material from contact with air can be provided, for example, by means of an argon supply in the flow area of the passage. It is to be noted that the method described in the following, accomplished by means of the device in FIG. 1, does not deal with an actual casting, because the hardened molten material is conducted upwards from the nozzle out of the canal. The band, or rather the thin slab, conducted from the out-flow opening 3 lies or is supported on transport rollers 8 and/or belts arranged next to the out-flow opening 3. The rollers 8 serve only to further conduct the band, or rather the thin slab, but not to pull it from the nozzle 2.

The method of the invention is as follows. The molten material such as metal fills and stands in the lower section of nozzle 2 and in vessel 1 to the level S. The heating unit 5 prevents unwanted premature freezing or solidification of the molten material on the walls of nozzle 2 and/or allows the precision regulation of the temperature of the molten material. Cooling unit 6 is operated to control solidification of the molten material being conducted through the nozzle 2 in direction of flow F. The vibration generator 7 imparts to the nozzle 2 a vibration component a parallel to the direction of flow F. The hardened molten material in the nozzle 2 in the form of a band or a thin slab is conducted out of the out-flow opening 3 onto the rollers 8 by high frequency vibrations imparted to nozzle 2. Upon leaving the out-flow opening 3, the hardened molten material can be a strip-shaped shell including an outer shell A of material that is already solidified and that surrounds an inner core B of material which is not yet solidified.

The cross section of the out-flow opening 3 and that of the nozzle 2 determine the shape of the drawn band or thin slab. Should particular cross sectional shapes of the drawn strip, for instance a wave form or ribbed form, be desired, then the nozzle 2 is provided with a corresponding cross sectional profile, at least in the area where the molten material is solidified. It is, however, possible to act on the upper surface of the molten material in the nozzle with directed vibrations to provide a profiling, for example with wave-shaped ribs in the longitudinal direction, and to allow the material to harden in such shape. The core B hardens during further transport of the band or the thin slab on the rollers 8. The vibration generator 7 imparts to the nozzle 2 vibration components b (see FIGS. 1 and 2), which are directed perpendicular to the direction of flow F. Vibration components b ensure that the molten material does not freeze onto the walls of the nozzle 2. In this way it is achieved that shell A of the hardening molten material does not set onto the walls of the nozzle 2.

The vibration generator 7 can impart to nozzle 2 additional vibration components c across the direction of flow F. Vibration components c guarantee, for example, an even distribution of the molten material over the width of the passage in the nozzle 2 so that at the out-flow opening 3 the shell A evenly fills the entire width, or rather the entire cross section, of the out-flow opening 3. In this way, the out-flow opening 3 lies above the level S of the molten material. The strip moves directly to the drawing-off device, after which the vessel 1 further is filled to its upper level S of molten material. The drawing-off process begins when the vibration generator 7, and if necessary, the cooling unit 6 are turned on and, if necessary, the heating unit 5 is turned off or heating is reduced. The discharge rate can be controlled by adjustment of the amplitude and the frequency of the vibration components a in connection with the cooling capacity of the cooling unit 6.

The nozzle 2 is solidly connected in the area of in-flow opening 4 with the vessel such that it can be removed therefrom. The connection is generally rigid. An elastic connection is foreseen if the vibrations imparted to the nozzle 2 by the vibration generator 7 must be isolated from the vessel 1. The nozzle can also be flexibly connected with the vessel 1. It is then possible to adjust the angle W to control the discharge rate. Thus the nozzle 2 can be oriented so that it extends horizontally or downwardly from the vessel 1.

To control the discharge rate it is also possible to control the level S of molten material or, if necessary, apply an excess or negative pressure within vessel 1. The heating unit 5 and the cooling unit 6 are mot required if the vibration generator 7 and the length of the nozzle 2 alone ensure that the molten material does not prematurely harden in the nozzle 2 and also that sufficient hardening occurs such that at least the hardened shell A leaves opening 3.

We claim:

1. A method of casting molten material into a strip-shaped product of substantially intended final dimensions, said method comprising:

supplying molten material into the interior of a vessel having connected thereto a casting nozzle formed of refractory ceramic material and having therethrough a passage extending from an inlet opening connected directly to said interior of said vessel to an outlet opening, with said nozzle being oriented relative to said vessel such that said outlet opening is positioned at a location that is higher than said inlet opening, whereby molten material passes from said vessel interior directly through said inlet opening and into said passage until an upper level of molten material in said passage is the same as an upper level of molten material in said vessel interior and is below said outlet opening;

commencing solidification of said molten material in said passage, thereby forming therein solidifying material; and moving said solidifying material through said passage in a direction toward said outlet opening, during which said material further solidifies, and discharging the thus further solidified material from said outlet opening, by imparting to said nozzle and thereby to said material ultrasonic vibrations including at least one vibration component in said direction.

2. A method as claimed in claim 1, wherein said molten material comprises molten metal.

3. A method as claimed in claim 1, wherein said vibrations are at least 20 kHz.

4. A method as claimed in claim 1, wherein said vibrations include at least one vibration component imparted in a direction substantially perpendicular to said direction.

5. A method as claimed in claim 1, wherein said vibrations include vibration components imparted on all walls of said nozzle in said direction.

6. A method as claimed in claim 1, wherein said vibrations include vibration components imparted on all walls of said nozzle in respective directions substantially perpendicular to said direction.

7. A method as claimed in claim 1, wherein said vibrations include vibration components imparted across a direction of flow of said molten material in said interior of said nozzle.

8. A method as claimed in claim 1, further comprising controlling said solidification of said molten material.

9. A method as claimed in claim 8, wherein said controlling comprises cooling said molten material in said nozzle at least until a hardened strip shell is formed therein.

10. A method as claimed in claim 8, wherein said controlling comprises inductively heating at least one of said nozzle and said molten material.

11. A method as claimed in claim 10, wherein said controlling further comprises cooling at least one of said nozzle and said molten material.

12. An apparatus for casting molten material into a strip-shaped produce of substantially intended final dimensions, said apparatus comprising:

a vessel having an interior into which molten material may be supplied;

a casting nozzle formed of refractory ceramic material and having therethrough a passage extending between an inlet opening and an outlet opening;

said nozzle being connected to said vessel, with said inlet opening of said nozzle directly connected to said interior of said vessel, and with said nozzle being oriented relative to said vessel such that said outlet opening is positioned at a location that is higher than said inlet opening, such that when molten material is supplied into said interior of said vessel molten material will pass from said vessel interior directly through said inlet opening and into said passage until an upper level of molten material in said passage is the same as an upper level of molten material in said vessel interior and is below said outlet opening, during which solidification of molten material in said passage commences, to thereby form solidifying material in said passage; and means for moving the solidifying material through said passage in a direction toward said outlet opening, during which the material further solidifies, and for discharging the thus further solidified material from said outlet opening, said means comprising at least one ultrasonic vibration generator on said nozzle and operable to impart thereto and to the material ultrasonic vibrations including at least one vibration component in said direction.

13. An apparatus as claimed in claim 12, wherein said vibrations are at least 20 kHz.

14. An apparatus as claimed in claim 12, wherein said nozzle has a closed transverse cross section.

15. An apparatus as claimed in claim 12, wherein said nozzle passage has a cross sectional configuration, at least adjacent said outlet opening, corresponding to the intended profile of a strip to be cast.

16. An apparatus as claimed in claim 12, further comprising a heating unit on said nozzle at a level to be below the upper level of molten material in said vessel.

17. An apparatus as claimed in claim 12, further comprising transport device positioned adjacent said outlet opening of said nozzle to receive therefrom a cast strip shaped product of solidified material discharged therefrom, said transport device being operable to support the product without imparting thereto longitudinal tension.

18. An apparatus as claimed in claim 12, further comprising a cooling unit on said nozzle at a level to be above the upper level of molten material in said vessel.

19. An apparatus as claimed in claim 18, wherein said cooling unit includes a portion extending below the molten material level.

* * * * *